US007775765B2

(12) United States Patent
Hoji

(10) Patent No.: US 7,775,765 B2
(45) Date of Patent: Aug. 17, 2010

(54) FLUID PUMP

(75) Inventor: Takeshi Hoji, Kanagawa (JP)

(73) Assignee: TBK Co., Ltd., Tokyo (JP)

( * ) Notice: Subject to any disclaimer, the term of this patent is extended or adjusted under 35 U.S.C. 154(b) by 710 days.

(21) Appl. No.: 11/574,828

(22) PCT Filed: Aug. 3, 2005

(86) PCT No.: PCT/JP2005/014609

§ 371 (c)(1),
(2), (4) Date: Mar. 7, 2007

(87) PCT Pub. No.: WO2006/035552

PCT Pub. Date: Apr. 6, 2006

(65) Prior Publication Data

US 2008/0317595 A1 Dec. 25, 2008

(30) Foreign Application Priority Data

Sep. 27, 2004 (JP) ..... 2004-279203

(51) Int. Cl.
*F04D 29/10* (2006.01)

(52) U.S. Cl. ..... 415/168.1; 415/168.2; 415/229; 415/231

(58) Field of Classification Search ..... 415/168.1, 415/168.2, 111, 112, 113, 229, 231, 170.1

See application file for complete search history.

(56) References Cited

U.S. PATENT DOCUMENTS

| | | | | |
|---|---|---|---|---|
| 5,026,253 | A * | 6/1991 | Borger | 415/229 |
| 5,217,350 | A * | 6/1993 | Kimura et al. | 415/175 |
| 6,200,089 | B1 * | 3/2001 | Heer | 415/168.2 |
| 6,764,278 | B2 | 7/2004 | Ozawa et al. | |
| 2002/0034438 | A1 | 3/2002 | Ozawa et al. | |

FOREIGN PATENT DOCUMENTS

JP 5-312186 11/1993

(Continued)

OTHER PUBLICATIONS

English Language Abstract of JP 2002-089486.

(Continued)

*Primary Examiner*—Igor Kershteyn
(74) *Attorney, Agent, or Firm*—Greenblum & Bernstein P.L.C.

(57) ABSTRACT

A pump pulley is supported on a pump body via a bearing interposed between the outer peripheral surface of the pump body and the pump pulley so that the pump pulley can freely rotate relative to the pump body. A pump shaft extends along the rotation axis of the pump pulley into a pump chamber formed by a pump base and the pump body, and one end of the pump shaft is fitted to the pump pulley and the other end is fitted to an impeller located within the pump chamber. A body side seal member and a shaft side seal member that form a mechanical seal to maintain the leak tightness of the pump chamber are in opposite to and contact each other in the direction of extension of the pump shaft to form a seal surface, and the plane that includes the load support center of the bearing and the plane that includes the seal surface of the mechanical seal are substantially coincidental.

12 Claims, 2 Drawing Sheets

FOREIGN PATENT DOCUMENTS

| | | |
|---|---|---|
| JP | 6-241324 | 8/1994 |
| JP | 2002-089486 | 3/2002 |
| JP | 2002-349481 | 12/2002 |
| JP | 2004-084610 | 3/2004 |
| JP | 2004-232507 | 8/2004 |

OTHER PUBLICATIONS

English Language Abstract of JP 2004-232507.
English Language Abstract of JP 6-241324, 1994.
English Language Abstract of JP 5-312186, 1993.
English Language Abstract of JP 2002-349481.
English Language Abstract of JP 2004-084610.
U.S. Appl. No. 11/612,044 to Hoji et al., filed Dec. 18, 2006.
U.S. Appl. No. 11/612,015 to Hoji et al., filed Dec. 18, 2006.
U.S. Appl. No. 11/574,827 to Hoji, filed Mar. 7, 2007.

* cited by examiner

FLUID PUMP

TECHNICAL FIELD

The present invention relates to a fluid pump provided in the engine of an automobile or the like, that is commonly referred to as a water pump.

BACKGROUND ART

Water (cooling water) is used as a medium (cooling medium) to cool cylinders and cylinder heads in water-cooled engines, including automobile engines, and a fluid pump is provided as a device to forcibly circulate the cooling water in a water jacket formed in the cylinder block of the engine. This type of fluid pump is commonly referred to as a water pump, and includes a pump base formed from a part of the cylinder block in which a cooling water outlet and inlet are formed, a pump body that is installed on the pump base to form a pump chamber, a pump pulley rotatably supported via a bearing (radial bearing) on the outer periphery of the pump body, a pump shaft connected at one end to the pump pulley and that extends into the pump chamber through an aperture in the pump body, and an impeller (vane wheel) installed on the other end of the pump shaft and positioned within the pump chamber. A drive belt connected to the crankshaft of the engine is fitted around the pump pulley, and when the pump pulley rotates when driven by the crankshaft, the pump shaft that is integral with the pump pulley and the impeller also rotate. When the impeller rotates, cooling water is drawn in from the inlet, forced out to the periphery by centrifugal force, and is expelled from the outlet into the water jacket (for example, see Japanese Patent Application Laid-open No. H5-312186, Japanese Patent Application Laid-open No. 2002-349481, and Japanese Patent Application Laid-open No. 2004-84610).

In this type of water pump it is necessary to maintain the leak tightness of the pump chamber, and sealing means is provided in the aperture of the pump body between the pump shaft and the pump body. Sealing means that include a member installed on the pump body (body side seal member) and a member installed on the pump shaft (shaft side seal member) known as a mechanical seal is frequently used as the seal means, and when the two seal members contact a sealing surface is formed.

DISCLOSURE OF THE INVENTION

Problems to be Solved by the Invention

However, in a conventional water pump the bearing and the seal means are normally disposed in a line along the axial direction, so when the pump shaft rotates when driven by the pump pulley, the pump shaft rotates with a very small deviation from the true axis of rotation, or what is known as shaft vibration occurs. When shaft vibration occurred in this way, relative oscillation occurred between the shaft side seal member and the body side seal member forming the seal means, so it was not possible to maintain a constant surface pressure on the seal surface, and there was the danger of leakage of liquid from the seal surface. Also, as described above, the bearing and the seal means are disposed in a line on the pump shaft in the axial direction, so there is a limitation on the reduction of the dimension of the pump shaft in the axial direction, which prevented the entire pump from being made more compact.

With the foregoing problems in view, it is an object of the present invention to provide a fluid pump capable of preventing leakage of liquid from the seal surface caused by shaft vibration of the shaft member, and with a configuration that allows the entire pump to be made more compact.

Means to Solve the Problems

A fluid pump according to the present invention comprises: a pump casing (for example, formed from the pump base 1 and the pump body 5 in the embodiments) having a pump chamber formed in the interior thereof, and an inlet and an outlet for fluid which are connected to the pump chamber; a bearing installed on the outer surface of a cylindrical portion projecting outwards from the pump casing; a pump drive member (for example the pump pulley 9 in the embodiments) which covers the cylindrical portion from the outer periphery side and that is rotatably installed on the pump casing via the bearing; a shaft member (for example, the pump shaft 10 in the embodiments) whose one end is attached to the pump drive member, and which passes through an aperture formed in the cylindrical portion, and projects into the pump chamber; a vane wheel (for example the impeller 11 in the embodiments) installed on the other end of the shaft member and positioned within the pump chamber; and sealing means (for example, the mechanical seal 12 in the embodiments) comprising a body side sealing member installed on the cylindrical portion in the inner periphery of the aperture and a shaft side sealing member installed on the shaft member that is in opposite to the body side sealing member in the axial direction, wherein fluid is drawn in from the inlet and expelled from the outlet by the rotation of the vane wheel within the pump chamber via the shaft member which rotates due to the rotation action of the pulley member driven by a power source (for example, the engine EG in the embodiments). Also, the load support plane which includes the center of the load support of the bearing and which extends perpendicularly to the axial direction, and the sealing plane on which the body side sealing member and the shaft side sealing member oppose and contact each other and which is perpendicular to the axial direction, are substantially coincidental in the axial direction.

It is desirable that the pump casing comprises a base member (for example, the pump base 1 in the embodiments) having the inlet and the outlet, and a body member (for example, the pump body 5 in the embodiments) which covers the inlet and the outlet and which is installed on the base member, and the cylindrical portion is formed in the body member.

In the fluid pump configured in this way, the base member may be formed integrally with a cylinder block in the side surface thereof and, the outlet connected to a water jacket formed in the cylinder block, and the fluid expelled from the outlet by the rotation of the vane wheel may be supplied within the water jacket.

Furthermore, it is desirable that the body member is formed integrally from the cylindrical portion on the external peripheral surface of which the bearing is installed and a bottom portion having a shape which expands from the inner end of the cylindrical portion and which covers the inlet and the outlet and which is connected to the base member to form the pump chamber, and that the aperture is formed within the area inside the inner peripheral surface of the bearing installed on the cylindrical portion.

ADVANTAGEOUS EFFECTS OF THE INVENTION

In the fluid pump according to the present invention the plane that includes the load support center (virtually the center of the bearing in the thickness direction) of the bearing that rotatably supports the pulley member (or the pump drive member) and the plane that includes the seal surface (the contact surface of the body side seal member and the shaft side seal member) of the sealing means that maintains the leak tightness of the pump chamber (both planes are perpendicular to the rotation axis of the pulley member) are virtually coincidental in the radial direction, so when the shaft member rotates together with the rotation action of the pulley member, even if shaft oscillation occurs the relative oscillation between the two seal members accompanying the rotation of the shaft member can be kept very small, and the pressure on the contact surface of the seal surface can be maintained constant. Therefore, it is possible to effectively prevent leakage of liquid from the seal surface of the seal means caused by shaft oscillation of the shaft member, and the leak tightness performance of the pump chamber can be improved. Also, in this configuration the seal means is disposed in an area to the inside of the inner peripheral surface of the bearing, so the dimension of the shaft member in the axial direction can be shortened compared with the conventional configuration in which the bearing and the seal means are disposed in a line on the shaft member in the axial direction, so it is possible to make the entire fluid pump lighter and more compact, and to reduce the manufacturing cost.

BEST MODE FOR CARRYING OUT THE INVENTION

Figure 1:
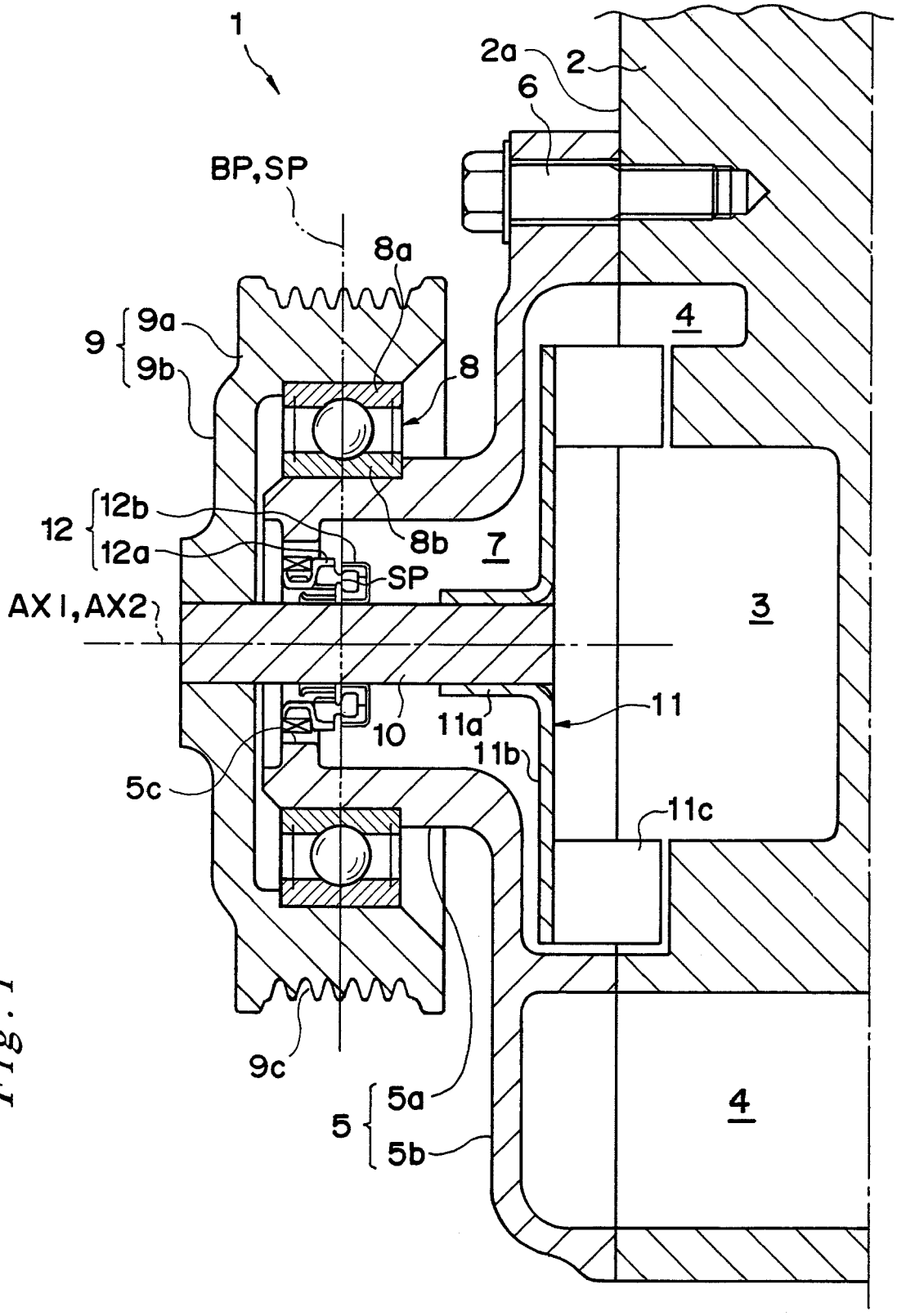
FIG. 1 is a side section view showing the configuration of the water pump according to a first embodiment of the fluid pump of the present invention.
Figure 2:
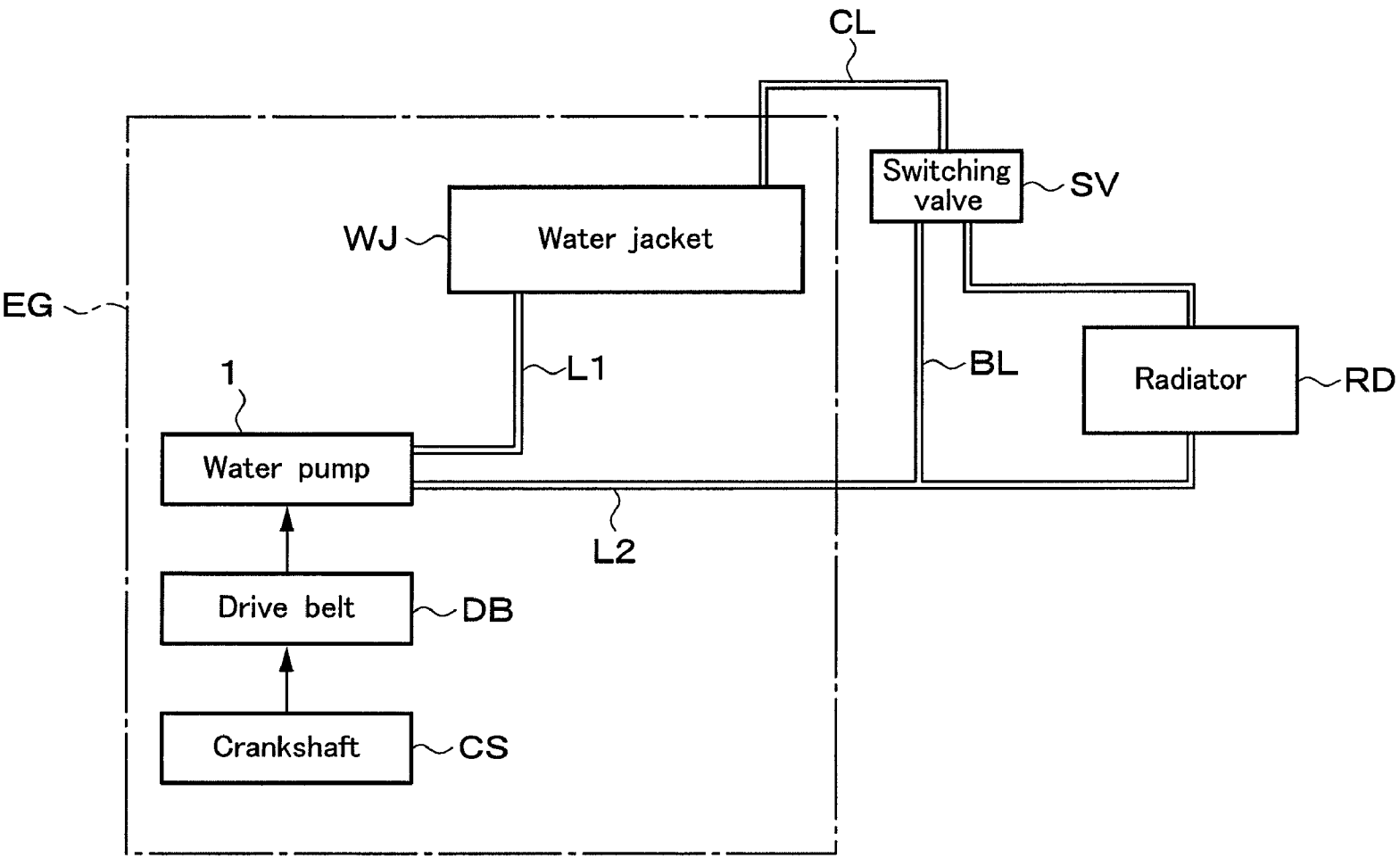
FIG. 2 is a block diagram showing the circulation channels of the cooling water of the above water pump.

The following is an explanation of the preferred embodiments with reference to the drawings. FIG. 1 is a side section view showing the configuration of the water pump 1 according to a first embodiment of the fluid pump of the present invention. In this embodiment the water pump 1 is used as the device to forcibly circulate cooling water in a water jacket WJ formed in the cylinder block of an automobile engine EG as shown in FIG. 2.

As shown in FIG. 1, the water pump 1 is assembled using a pump base 2 in part of the cylinder block of an engine EG as the base. The pump base 2 includes an outlet 3 that connects to a cooling water outlet channel L1 that leads to the water jacket WJ, and an inlet 4 that connects to a cooling water return channel L2, the two ports 3, 4 are apertures in the surface 2*a* of the pump base 2 (the left surface in FIG. 1).

A pump body 5 is installed on the surface 2*a* of the pump base 2 using a plurality of bolts 6 so that the pump body 5 can be freely attached and removed, to form a pump chamber 7 in the space enclosed by the pump base 2 and the pump body 5. The pump base 2 and the pump body 5 constitute a pump casing. The pump body 5 includes a hollow cylindrical portion 5*a*, and a bottom portion 5*b* that extends outwards from one end of the cylindrical portion 5*a*, and when the pump body 5 is installed on the pump base 2, the outlet 3 and the inlet 4 formed in the pump base 2 are covered by the bottom portion 5*b*. Also, the cylindrical portion 5*a* extends normal to the surface 2*a* of the pump base 2 (in FIG. 1, the left-right direction in the plane of the paper).

A pump pulley 9 is installed in a position concentric with the outer periphery of the cylindrical portion 5*a* of the pump body 5 via a bearing (radial bearing) 8. The pump pulley 9 has a cylindrical shape with a bottom, and includes a hollow cylindrical portion 9*a* that covers the outer peripheral surface of the cylindrical portion 5*a* of the pump body 5, and a bottom portion 9*b* provided on a side end of the hollow cylindrical portion 9*a*, an outer race 8*a* of the bearing 8 is fixed to an inner peripheral surface of the pump pulley 9, and an inner race 8*b* of the bearing 8 is fixed to the outer peripheral surface of the pump body 5, so that the pump pulley 9 is concentric with the pump body 5 and supported so that the pump pulley 9 can freely rotate relative to the pump body 5. Grooves 9*c* are formed in the outer peripheral surface of the pump pulley 9, on which a drive belt DB that is connected to a crankshaft CS of the engine EG is fitted, the rotation drive force of the crankshaft CS is transmitted to the pump pulley 9 via the drive belt DB fitted to the belt grooves 9*c*, so that the pump pulley 9 is driven to rotate. Therefore, the load (the belt load) from the drive belt DB onto the pump pulley 9 acts in a direction at right angles to the shaft, but to prevent eccentric loads from acting on the bearing 8 and to improve the durability of the bearing 8, the position of the center of the belt grooves 9*c* on the outer peripheral surface of the pump pulley 9 in the width direction and the position of the center in the width direction of the bearing 8 (center of the position of load support of the bearing 8) are virtually coincidental in the radial direction.

One end of a pump shaft 10 is installed on the bottom portion 9*b* of the pump pulley 9 by press fitting, penetrates an aperture 5*c* formed in an end of the cylindrical portion 5*a* of the pump body 5, and extends into the pump chamber 7, with the central axis AX2 of the pump shaft 10 coinciding with the rotation axis AX1 (the axis of the center of rotation of the outer race 8*a* of the bearing 8) of the pump pulley 9. The aperture 5*c* is formed in an area to the inside of the inner surface of the inner race 8*b* of the bearing 8 installed on the cylindrical portion 5*a*. An impeller (vane wheel) 11 is fixed to the other end of the pump shaft 10, and the impeller 11 is disposed within the pump chamber 7. The impeller 11 includes a flat plate 11*b* in the center of which is a hollow cylindrical shaped shaft installation portion 11*a*, and a plurality of blades 11*c* installed on the flat plate 11*b*, and the pump shaft 10 is fixed to the impeller 11 by press fitting the pump shaft 10 into the shaft installation portion 11*a*.

The space between the pump shaft 10 and the aperture 5*c* of the pump body 5 is sealed by a mechanical seal 12. The mechanical seal 12 includes a ring shaped body side seal member 12*a* fixed to the inner periphery of the aperture 5*c* of the pump body 5, and a ring shaped shaft side seal member 12*b* fixed by press fitting to the center of the pump shaft 10, the body side seal member 12*a* and the shaft side seal member 12*b* are in opposition in the direction of the central axis AX2 of the pump shaft 10 and maintain leak tightness of the pump chamber 7 by sliding contact. Here, as shown in FIG. 1, the sealing plane SP (contact surface of the body side seal member 12*a* and the shaft side seal member 12*b*) of the mechanical seal 12 that maintains the leak tightness of the pump chamber 7 is virtually coincidental with the plane BP that includes the center of the load support of the bearing 8 (the center in the thickness direction of the bearing 8) that rotatably supports the pump pulley 9 (the sealing plane SP and the center of the load support plane BP are both planes normal to the rotation axis AX1 of the pump pulley 9).

As shown in FIG. 2, the pump pulley 9 of the water pump 1 is driven by the crankshaft CS of the engine EG via the drive belt DB. In this way, the pump shaft 10 that is integral with the pump pulley 9 also rotates together with the impeller 11. As the impeller 11 rotates, the cooling water in the return channel L2 is drawn into the inlet 4, is acted on by centrifugal force due to the rotation of the impeller 11 and forced to the outer periphery, and is expelled from the outlet 3 to the outlet channel L1. The cooling water that is expelled into the outlet channel L1 is driven to the water jacket WJ, and after cooling the cylinder and cylinder head (neither of which are shown in the drawings) of the engine EG flows from a continuation channel CL to a radiator RD where the cooling water emits the heat. Then, the cooling water again returns to the water pump 1 from the return channel L2, and is drawn in through the inlet 4 and expelled from the outlet 3. A switching valve SV that is operated by a thermostat is provided in the continuation channel CL, and when the temperature of the cooling water is higher than a set temperature the cooling water flows to the radiator RD, but when the temperature of the cooling water is lower than the set temperature, the cooling water flows through a bypass channel BL. The bypass channel BL extends to the return channel L2 without passing through the radiator RD, so the cooling water is directly drawn into the water pump 1. In this way, the water pump 1 forcibly circulates the cooling water within the water jacket WJ.

The water pump 1 has the configuration as described above, but in the water pump 1, the plane BP that includes the center of the load support of the bearing 8 that rotatably supports the pump pulley 9 is virtually coincidental with the sealing plane SP (contact surface of the body side seal member 12*a* and the shaft side seal member 12*b*) of the mechanical seal 12 that maintains the leak tightness of the pump chamber 7, so even if shaft vibration is caused when the pump shaft 10 rotates together with the rotation action of the pump pulley 9, the relative oscillations between the two seal members 12*b*, 12*a* accompanying the rotation of the pump shaft 10 can be kept very small, and the surface pressure on the seal surface SP can be maintained constant. Therefore it is possible to prevent liquid leakage from the seal surface SP of the mechanical seal 12 caused by shaft vibration of the pump shaft 10, and improve the leak tightness performance of the pump chamber 7. Here, the amount of relative oscillation between the two seal members 12*b*, 12*a* when the pump shaft 10 vibrates can be minimized, as shown in FIG. 1, when the plane BP that includes the center of the load support of the bearing 8 and the sealing plane SP of the mechanical seal 12 are perfectly coincidental, but if the plane BP that includes the center of the load support of the bearing 8 and the sealing plane SP of the mechanical seal 12 are virtually coincidental the above effect can be sufficiently obtained.

Also, in this type of configuration the mechanical seal 12 is disposed to the inside of the inner peripheral surface of the bearing 8 (inner peripheral surface of the inner race 8*b*), so it is possible to reduce the dimension of the pump shaft 10 in the axial direction compared with the conventional configuration in which the bearing and the mechanical seal are disposed in a line on the pump shaft in the axial direction, so it is possible to make the entire water pump 1 lighter, more compact, and with a lower manufacturing cost.

So far the preferred embodiments of the present invention have been explained, but scope of the present invention is not limited to the embodiments as described above. For example, instead of a configuration in which the pump pulley 9 is driven by the crankshaft CS via the drive belt DB, a configuration in which the crankshaft CS drives via a gear mechanism is also possible. Also, the fluid pump according to the present invention is not limited to use for cooling an automobile engine, the present invention may be applied to engines of other power machinery, or the present invention is not limited to use for engine cooling, but may be applied to all kinds of fluid pumps used for supplying liquids. Also, the fluid used in the fluid pump according to the present invention is not limited to water, oil or other fluids may also be used.

What is claimed is:

1. A fluid pump, comprising:

a pump casing having a pump chamber formed in the interior thereof and an inlet and an outlet for fluid which are connected to the pump chamber;

a bearing installed on the outer surface of a cylindrical portion projecting outwards from the pump casing;

a pump drive member which covers the cylindrical portion from the outer periphery side and that is rotatably installed on the pump casing via the bearing;

a shaft member whose one end is attached to the pump drive member, and which passes through an aperture formed in the cylindrical portion and projects into the pump chamber;

a vane wheel installed on the other end of the shaft member, positioned within the pump chamber;

sealing means comprising a body side sealing member installed on the cylindrical portion in the inner periphery of the aperture and a shaft side sealing member installed on the shaft member opposite to the body side sealing member in the axial direction, wherein fluid is drawn in from the inlet and expelled from the outlet by the rotation of the vane wheel within the pump chamber via the shaft member which rotates due to the rotation action of the pump drive member driven by a power source, and the load support plane which includes the center of the load support of the bearing and which extends perpendicularly to the axial direction and the sealing plane on which the body side sealing member and the shaft side sealing member oppose and contact each other and which is perpendicular to the axial direction are substantially coincidental;

wherein the pump casing comprises a base member having the inlet and the outlet, and a body member which covers the inlet and the outlet and which is installed on the base member, and the cylindrical portion is formed in the body member.

2. The fluid pump according to claim 1, wherein the base member is formed integrally with a cylinder block in the side surface thereof, the outlet is connected to a water jacket formed in the cylinder block, and the fluid expelled from the outlet by the rotation of the vane wheel is supplied within the water jacket.

3. The fluid pump according to claim 1, wherein the body member is formed integrally from the cylindrical portion on the external peripheral surface of which the bearing is installed, and a bottom portion having a shape which expands from the inner end of the cylindrical portion and which covers the inlet and the outlet and which is connected to the base member to form the pump chamber, and the aperture is formed within the area inside the inner peripheral surface of the bearing installed on the cylindrical portion.

4. The fluid pump according to claim 1, wherein the pump drive member is formed in the shape of a cylinder with a bottom comprising a hollow cylindrical portion which covers the cylindrical portion of the body member from the outer peripheral side and a bottom provided on a side end of the hollow cylindrical portion, an outer race of the bearing is fixed to the inner peripheral surface of the hollow cylindrical portion of the pump drive member and an inner race of the bearing is fixed to the outer peripheral surface of the cylindrical portion of the body member so that the pump drive member is concentric with the body member and supported to be able to freely rotate.

5. The fluid pump according to claim 1, wherein belt grooves are formed on the outer peripheral surface of the pump drive member on which a drive belt is fitted to connect with the drive source, so that a rotational driving force of the drive source is transmitted to the pump drive member via the drive belt fitted to the belt grooves and the pump drive member is driven to rotate, and the center position of the belt grooves of the pump drive member in the width direction substantially coincides with, in an axial direction, the center position of the load support of the bearing.

6. The fluid pump according to claim 2, wherein the pump drive member is formed in the shape of a cylinder with a bottom comprising a hollow cylindrical portion which covers the cylindrical portion of the body member from the outer peripheral side and a bottom provided on a side end of the hollow cylindrical portion, an outer race of the bearing is fixed to the inner peripheral surface of the hollow cylindrical portion of the pump drive member and an inner race of the bearing is fixed to the outer peripheral surface of the cylindrical portion of the body member so that the pump drive member is concentric with the body member and supported to be able to freely rotate.

7. The fluid pump according to claim 3, wherein the pump drive member is formed in the shape of a cylinder with a bottom comprising a hollow cylindrical portion which covers the cylindrical portion of the body member from the outer peripheral side and a bottom provided on a side end of the hollow cylindrical portion, an outer race of the bearing is fixed to the inner peripheral surface of the hollow cylindrical portion of the pump drive member and an inner race of the bearing is fixed to the outer peripheral surface of the cylindrical portion of the body member so that the pump drive member is concentric with the body member and supported to be able to freely rotate.

8. The fluid pump according to claim 2, wherein belt grooves are formed on the outer peripheral surface of the pump drive member on which a drive belt is fitted to connect with the drive source, so that a rotational driving force of the drive source is transmitted to the pump drive member via the drive belt fitted to the belt grooves and the pump drive member is driven to rotate, and the center position of the belt grooves of the pump drive member in the width direction substantially coincides with, in an axial direction, the center position of the load support of the bearing.

9. The fluid pump according to claim 3, wherein belt grooves are formed on the outer peripheral surface of the pump drive member on which a drive belt is fitted to connect with the drive source, so that a rotational driving force of the drive source is transmitted to the pump drive member via the drive belt fitted to the belt grooves and the pump drive member is driven to rotate, and the center position of the belt grooves of the pump drive member in the width direction substantially coincides with, in an axial direction, the center position of the load support of the bearing.

10. The fluid pump according to claim 4, wherein belt grooves are formed on the outer peripheral surface of the pump drive member on which a drive belt is fitted to connect with the drive source, so that a rotational driving force of the drive source is transmitted to the pump drive member via the drive belt fitted to the belt grooves and the pump drive member is driven to rotate, and the center position of the belt grooves of the pump drive member in the width direction substantially coincides with, in an axial direction, the center position of the load support of the bearing.

11. The fluid pump according to claim 6, wherein belt grooves are formed on the outer peripheral surface of the pump drive member on which a drive belt is fitted to connect with the drive source, so that a rotational driving force of the drive source is transmitted to the pump drive member via the drive belt fitted to the belt grooves and the pump drive member is driven to rotate, and the center position of the belt grooves of the pump drive member in the width direction substantially coincides with, in an axial direction, the center position of the load support of the bearing.

12. The fluid pump according to claim 7, wherein belt grooves are formed on the outer peripheral surface of the pump drive member on which a drive belt is fitted to connect with the drive source, so that a rotational driving force of the drive source is transmitted to the pump drive member via the drive belt fitted to the belt grooves and the pump drive member is driven to rotate, and the center position of the belt grooves of the pump drive member in the width direction substantially coincides with, in an axial direction, the center position of the load support of the bearing.

* * * * *